US008151534B1

(12) United States Patent
Green et al.

(10) Patent No.: US 8,151,534 B1
(45) Date of Patent: Apr. 10, 2012

(54) ELEVATED RETAINER FOR ROOFING TILES

(76) Inventors: Robert Dallas Green, Navarre, FL (US); Robert W. Green, DeSoto, TX (US)

( * ) Notice: Subject to any disclaimer, the term of this patent is extended or adjusted under 35 U.S.C. 154(b) by 0 days.

(21) Appl. No.: 13/199,357

(22) Filed: Aug. 26, 2011

Related U.S. Application Data

(63) Continuation of application No. 12/157,432, filed on Jun. 10, 2008, now Pat. No. 8,006,456.

(51) Int. Cl.
*E04D 1/34* (2006.01)

(52) U.S. Cl. ..... 52/547; 52/512; 52/543

(58) Field of Classification Search ..... 52/510, 52/512, 536, 543, 547, 549, 551; 248/237
See application file for complete search history.

(56) References Cited

U.S. PATENT DOCUMENTS

| | | | | |
|---|---|---|---|---|
| 1,463,482 | A * | 7/1923 | Mountford | 52/547 |
| 1,544,391 | A * | 6/1925 | Budd et al. | 52/547 |
| 1,544,392 | A * | 6/1925 | Budd et al. | 52/547 |
| 3,181,662 | A * | 5/1965 | Maertzig, Jr. | 52/509 |
| 4,031,681 | A * | 6/1977 | Charniga | 52/408 |
| 4,281,494 | A * | 8/1981 | Weinar | 52/489.2 |
| 4,314,433 | A * | 2/1982 | Hulcombe | 52/521 |
| 4,435,933 | A * | 3/1984 | Krowl | 52/309.1 |
| 5,077,952 | A * | 1/1992 | Moore | 52/489.1 |
| 5,165,642 | A * | 11/1992 | Rihaly | 248/237 |
| 5,722,212 | A * | 3/1998 | Struve et al. | 52/712 |
| 5,885,024 | A * | 3/1999 | Zupan et al. | 403/389 |
| 6,367,220 | B1 * | 4/2002 | Krause et al. | 52/512 |
| 2003/0097810 | A1 * | 5/2003 | Leichtfried | 52/518 |
| 2004/0074188 | A1 * | 4/2004 | Beck et al. | 52/522 |

FOREIGN PATENT DOCUMENTS

| | | | |
|---|---|---|---|
| DE | 3329812 | A1 * | 2/1985 |
| GB | 2228502 | A * | 8/1990 |
| GB | 2241262 | A * | 8/1991 |

* cited by examiner

*Primary Examiner* — Robert Canfield
*Assistant Examiner* — Babajide Demuren
(74) *Attorney, Agent, or Firm* — Ramon L. Pizarro; Edward H. Crabtree

(57) ABSTRACT

An elevated retainer is disclosed for retaining roofing tile that include tile lugs against a roofing surface. The elevated retainer includes a retainer head, the retainer head having a base and a top. Extending from the retainer head is a reinforcing strip with as nail slot. The reinforcing strip being adapted for extending in generally parallel to the roofing surface when the base of the retainer head is placed against the roofing surface. The device also includes lug retainer that engages lugs of the roofing tile while the tile lies between the reinforcing strip and the lug retainer.

4 Claims, 3 Drawing Sheets

SECTION D-D

ELEVATED RETAINER FOR ROOFING TILES

REFERENCE TO RELATED APPLICATIONS

This application is a continuation of my non-provisional patent application titled "ELEVATED RETAINER FOR ROOFING TILES", filed on 10 Jun. 2008 with Ser. No. 12/157,432, now U.S. Pat. No. 8,006,456, incorporated herein in its entirety by reference.

BACKGROUND OF THE INVENTION (a) Field of the Invention

This invention generally relates to a device and method for installing and retaining roofing tile on a roof. More particularly, but not by way of limitation, to a elevated retainer that engages portions of roofing tile and enhances the nailing, retention, and cooperation of the roofing tiles improve installation productivity and resistance of the installations to winds.

(b) Discussion of Known Art

Tile has been a well-regarded roofing material for centuries. The aesthetics qualities and durability of tile roofing materials have been balanced against the cost associated with the materials and skill required to install these tile roofing. Perhaps the most popular types of tile used today include Roman, Greek, French, Interlocking, Flat Slab (Dowager Queen), and Spanish or Mission styles of tile.

The installation of the roofing tile is carried out over the roofing surface, which is typically plywood covered with a waterproofing membrane and a wood batten or batten and lath matrix. A horizontal line, made with the use of chalk line, is used as a guide for the batten or lath and the positioning of the tile. The roofing tile typically includes an upper edge, or "head", and a lower edge, or "nose". The upper edge is designed for mounting at a higher location on the roof than the lower edge. At least one nail hole is typically found at about the middle of the tile, next to the upper edge. At least one "head lug" is found near the upper edge of the tile; the head lugs provide mechanical engagement over battens or lath, or provide a stable foundation for attachment to the roofing surface.

A significant problem encountered in the use of tile roofing is the roof's resistance to high winds. Often times high winds will lift the tiles from the roof, causing the tiles tear away from the roof. What typically occurs is that the nose of the tile is lifted by the wind and the tile flipped up or rotated about its attachment point near the head of the tile.

A common problem associated with the use of battens is that they can capture moisture and debris that may have been trapped between the tiles and the roofing surface. This leads to rapid deterioration of the roofing surface. The battens are often mounted on top of counter battens or lath that have been mounted perpendicularly to the horizontal battens. This raising of the battens is designed minimize the capture of moisture along the horizontal batten. A problem associated with this solution is that it further raises the head of the tiles and provides a passage for wind under the tiles, and thus facilitates the lifting of the roofing tiles in a storm.

There are known clips that can be used to facilitate the installation of roofing tile, but these do not fully cooperate with the features of the tile to provide an inherently secure attachment of the tile, and do not enhance resistance to lifting of the tile in high winds.

SUMMARY

It has been discovered that problems unresolved by known art can be solved with an elevated retainer that cooperates with roofing tile having lugs, the elevated retainer assists in the retention of the roofing tile against a roofing surface that is sloped from an upper roofing surface towards a lower roofing surface, the elevated retainer including:

A retainer head, the retainer head having a base and a top, the base being adapted for placement near the roofing surface so that the base is closer to the roofing surface than the top, the retainer head having a retainer nail channel;

A reinforcing strip that extends from the retainer head in a direction, the reinforcing strip having a nail slot;

A lug retainer, the lug retainer extending from the base of the retainer head in the same direction as the reinforcing strip, the lug retainer having a lug upper end and a lug lower end, the lug further having a lug hook that is at a distance from the base of the retainer head, so that attachment of the elevated retainer through the use of a nail through the retainer nail channel and into the roofing surface while the reinforcing strip and the lug retainer extend towards from the retainer head towards the lower roofing surface allows the insertion of the roofing tile into the elevated retainer with the lugs of the roofing tile are engaged by the lug retainer while the tile lies between the reinforcing strip and the lug retainer.

According to a highly preferred embodiment of the invention the lug retainer includes resilient feet that extend from the lug retainer towards the reinforcing strip, the feet being located between the lug hook and the base of the retainer head. The resilient feet will help clamp the roofing tile in the elevated retainer by pressing against the lugs of the tile, and squeezing the tile between the lug retainer and the reinforcing strip.

It will be understood that the elevated retainer disclosed here cooperates with the tile in order to keep the nose of the tile from lifting in a storm. Additionally, the disclosed elevated retainer is designed to allow water to flow around the retainer, and thus minimize the undesired retention of water and debris between the tiles and the roofing surface.

Additionally, the disclosed elevated retainer will allow the use of two fasteners at locations where a single fastener was used through the tile holes. The use of two fasteners, one through the reinforcing strip and one through the retainer head, will provide a more secure retention of the tile than could be achieved with a single fastener through the nail hole. Furthermore, the reinforcing strip will urge the nose down, towards the roofing surface, while a lug hook that is part of the elevated retainer engages the lug or lugs on the tile to further prevent rotation or lifting of the nose of the tile under strong winds. Still further, the retainer head will also cooperate with the head of the tile to keep the nose of the tile in the desired position.

Still further, it is contemplated that the disclosed elevated retainer may be supplied separately, to be attached to the roofing surface during construction. Alternatively, it is contemplated that the elevated retainer may be pre-mounted along a batten, which may incorporate water passages, such that the batten will contain several of the elevated retainers along the batten. This arrangement would allow the precise placement of the tiles on the roof, minimizing the reliance on the installer's skills. Similarly, the elevated retainers may be pre-mounted or attached to a flexible strip, such as a fabric strip or an integral strip that includes multiple elevated retainers that are of one-piece construction with the integral strip.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

Figure 4:
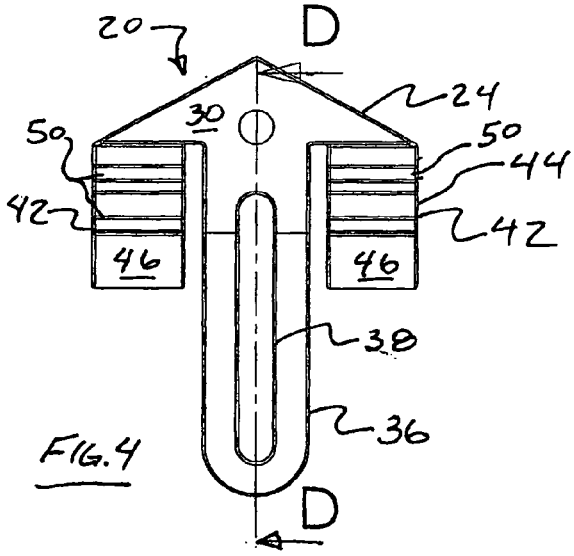
FIG. 4 is a top, plan view, of a highly preferred embodiment of the disclosed invention.
Figure 8:
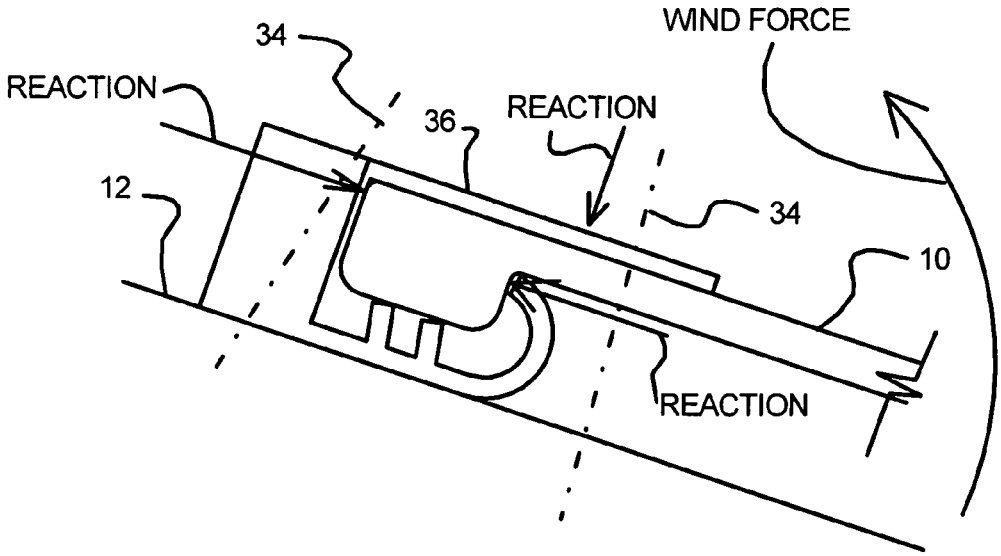

FIG. 8 side view of the example illustrated in FIG. 4 while supporting a roofing tile, and illustrating the force reactions while resisting the lifting of a roofing tile.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
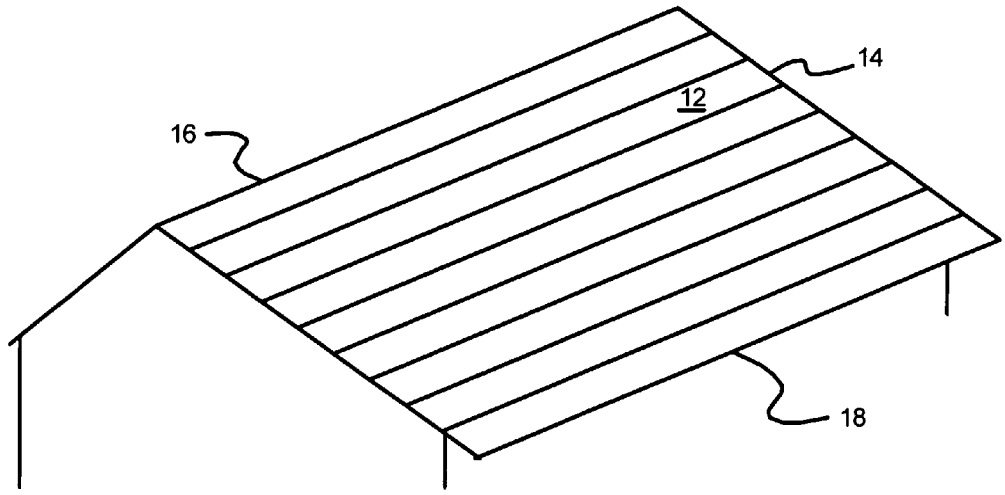
FIG. 1 illustrates a roof with a roof surface prior to the installation of the disclosed invention.
Figure 2:
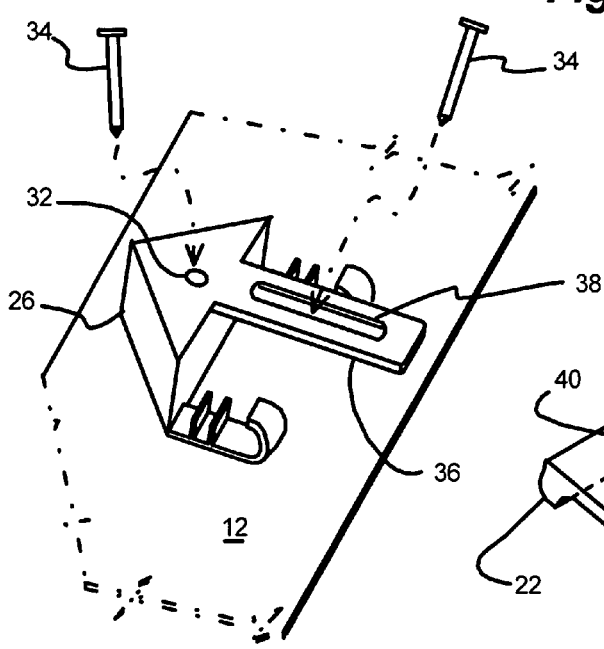
FIG. 2 illustrates the disclosed elevated retainer prior to the insertion of a nail for attachment of the elevated retainer on the roof surface.
Figure 3:
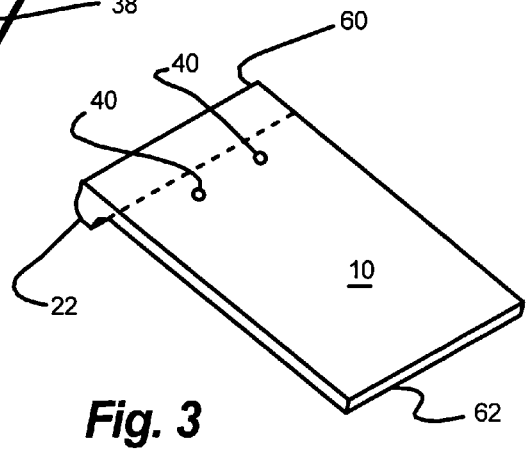
FIG. 3 illustrates a common type of roof shingle, with the lugs, which protrude from the bottom or lower surface, being shown in dashed lines.
Figure 7:
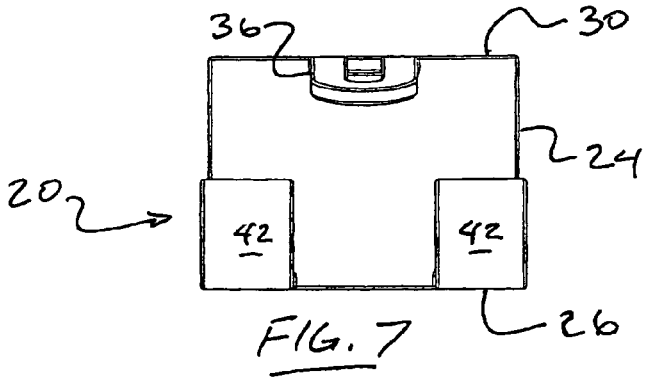
FIG. 7 is an end view of the example illustrated in FIG. 4, the view looking at the disclosed invention from between the reinforcing strip and the lug retainer towards the retainer head.

Attention is directed to FIGS. 1-3, which will be used to discuss the disclosed device and method for retaining a roofing tile 10 against a roofing surface 12. It will be noted that the roof 14 includes the roofing surface 12, which is sloped from an upper roofing surface 16 towards a lower roofing surface 18. The roofing tiles 10 will be installed on the roofing surface 12 through the use an elevated retainer 20, disclosed here.

As illustrated in FIG. 3, the roofing tile 10 will include spaced-apart lugs 22 that extend from the lower surface 24 of the roofing tile 10. These lugs 22 are common to roofing tile, and while shown on a flat roofing tile, they are not unique to flat roofing tile, but can be found in the various styles of roofing tile discussed above. Accordingly, it is contemplated that the invention or inventive aspects disclosed here can be used with various styles of lug-containing tiles, and not just the flat style of roofing tile. The roofing tiles 10 also include an upper edge 60 and a lower edge 62. The tile being adapted for installation on the roofing surface 24 with the lower edge 62 being further down the slope of the roof than the upper edge 62.

Figure 5:
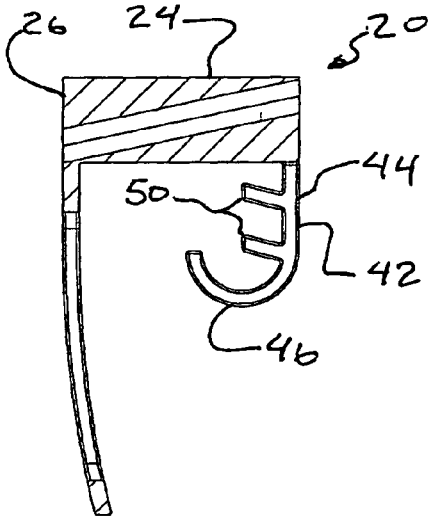
FIG. 5 is a section view taken from FIG. 4 along the line D-D, and viewed in the direction indicated by the arrows next to the reference characters D-D.
Figure 6:
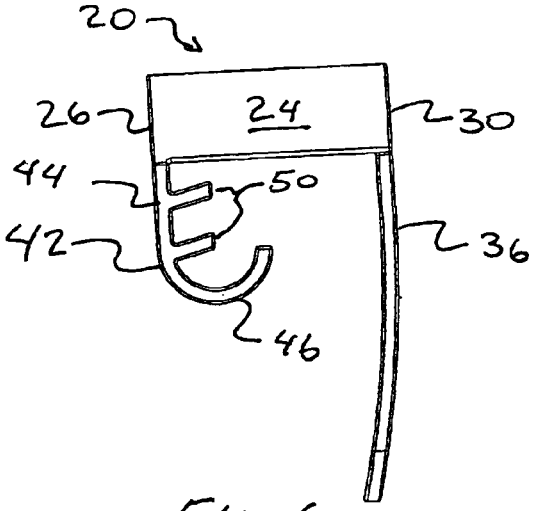
FIG. 6 is a side view of the example illustrated in FIG. 4.

As illustrated in FIGS. 2, 4 and 6, the disclosed elevated retainer 20 includes a retainer head 24 that includes a base 26 and a top 30. The base 26 has been adapted for placement on or near the roofing surface 12, such that the base 26 is closer to the roofing surface 12 than the top 30. This adaptation in this example is accomplished by simply making the base 26 generally flat because the illustrated roofing surface is flat. However, if other contours or surface materials are found on the roofing surface, then the base could be modified to match these contours or surfaces. Also illustrated on FIGS. 2, 4 and 5 is that the retainer head 24 will preferably include a retainer nail channel 32 to allow the user to insert a nail 34, screw or other fastening device, through the head 24 to fasten the disclosed invention to the roofing surface 12 or to a batten or lath that may have been used as part of the roofing surface 12.

While it is contemplated that the disclosed elevated retainer may be attached to a batten or lath that extends across the roofing surface 12, it is also contemplated that the disclosed elevated retainer may be fastened directly to the roofing surface 12. In this type of application the user would simply create a chalk line across the roofing surface 12, and then fasten the elevated retainers 20 along the chalk line at appropriate spaces. Still further it is contemplated that elevated retainers may be pre-attached, with adhesives or mechanical fasteners, to sections of batten or lath at appropriate locations along the batten or lath, the user would simply draw a chalk line, position the batten or lath along the chalk line, and then drive the nail 34 into the roofing surface 12. Alternatively, sections of batten or lath with markings to indicate the appropriate location for the placement of the elevated retainer 20, which is then fastened to the roofing surface 12 at that location.

FIGS. 4-7 also illustrate that a preferred example of the elevated retainer 20 also includes a reinforcing strip 36 that extends from the retainer head 24. The reinforcing strip 36 is attached to the retainer head 24 such that it extends from the retainer head 24 in a direction that is generally parallel to the roofing surface 12 when the base 26 of the retainer head 26 is placed against the roofing surface 12. However, as shown on FIG. 5, it is preferred that the reinforcing strip 36 will be slightly canted or curved towards the roofing surface 12. The reinforcing strip 36 will preferably include an aperture 38 that extend through the reinforcing strip 36. The aperture 38 will define a nail slot 40 that extends through the reinforcing strip 36 to facilitate the location of the nail hole 40 of the roofing tile 10, as illustrated in FIG. 3.

FIGS. 4-7 also illustrate that a preferred example of the elevated retainer 20 will also include at least one lug retainer 42, and in the disclosed example where the roofing tile 10 include two lugs 40, the elevated retainer 20 includes a pair of lug retainers 42, each to engage one of the lugs of the roofing tile 10. Each of the lug retainers 42 includes a cantilevered section 44 that extends from the base 26 of the retainer head 24 in substantially the same direction as the reinforcing strip 36, although in the preferred example these two components have a slight convergence due to the canting or curvature of the reinforcing strip 36. Additionally, each of the lug retainers 42 includes a lug hook 46, which in a preferred example is a section that is bent up towards the reinforcing strip 36, and serves to engage the sides of the lugs 40. The lug hook 46 is at a distance from the base 26 of the retainer head 24, and is curved or bent back towards the retainer head in order to accommodate variations in the locations of the lugs 40 relative to the edge 48 of the roofing tile 10.

Additionally, as illustrated in FIGS. 4-7, it is contemplated that the lug retainers 42 will also include at least one, but preferably a pair of resilient elevated feet 50 that extend from the lug retainer 42 towards the reinforcing strip 36. The elevated feet 50 serve to accommodate variations in thickness of the roofing tile or the length of the lugs in various roofing tile, whether the variations are created by the fact that the tiles are of different designs or due to manufacturing variations within a particular style of tile. The preferred example of the elevated feet 50 is simply a cantilevered projection that is of integral, one-piece construction with the lug retainer 42, and is positioned between the lug hook 46 and the retainer head 24. As illustrated in FIGS. 4-6, it is contemplated that a pair of elevated 50 will be incorporated into each of the lug retainers 42, each being of integral, one-piece construction, as is the entire elevated retainer.

Referring once again to FIG. 2, it will be understood that the elevated retainer 20 will attached to the roofing surface 12 fastening the retainer head 24 against the roofing surface 12 by driving a nail 34 through the nail channel 32 with the base 26 of the head 24 faces the roofing surface 12, while the lug retainer 42 and the reinforcing strip 36 are pointed towards the lower roofing surface 18. Then the roofing tile 10 is inserted into the elevated retainer 20 such that the lugs 22 of the roofing tile 10 are engaged by the lug retainers 42 while the tile 10 lies between the reinforcing strip 36 and the lug retainer 42, and such that the retainer nail channel extends over the tile nail hole 40 to allow the insertion of the nail 34 through the retainer nail channel 32 and through the tile nail hole 40, through the lug retainer 42 and into the roofing surface 12 to retain the tile on the roofing surface.

It will be understood that the use of the disclosed elevated retainer 20 will increase the wind resistance of the finished roof. The cooperation of the lug retainers 42 with the lugs 22, and the resistance imposed by the retainer head engaging the roofing tile 10 will help keep the lower edge 62 of the tile pressed towards the roofing surface 12. The cumulative effect of several rows of tiles that have been mounted using the disclosed elevated retainers 20 being that each tile not only benefits from the retention forces imposed by the elevated retainer used on that tile, but benefits from the retention forces imposed by the cumulative effect of the succeeding rows of tile that have been installed above that tile. With the use of the disclosed invention each tile benefits from the use of two nails that help retain the tile, and befit from the bias imposed by the elevated retainer 20, forcing the lower edge 62 of the roofing tile 10 towards the roofing surface 12.

Turning now to FIG. 8, it will be understood that the disclosed elevated retainer 10 will change the pivot point of the rotation of the tile, and by changing the pivot point, one increases the leverage arm and thus the resistance to flipping of the tile by high winds. The joining of the fastening the reinforcement strip 36 with the tile 10 allows the tile 10 and the elevation retainer 10 to work as a unit, with the lift on the tile 10 as caused by the wind force being reacted by the elevated retainer. The use of the elevated retainer will thus allow the use of a pair of nails 34, at each location where the tile 10 originally allowed only one nail or fastener. Furthermore, the spacing of the nails or fasteners between the head of the tile and the nose of the tile allows the positioning of the fasteners in a manner that gives the assembly greater resistance to the wind force as compared to simply attaching the nails 34 or fasteners along a line that is generally parallel to the nose of the tile 10.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An elevated retainer for retaining roofing tile against a roofing surface, the elevated retainer comprising:

a retainer head, the retainer head having a base and a top, the base being adapted for placement near the roofing surface so that the base is closer to the roofing surface than the top, the retainer head having a retainer nail channel;

a reinforcing strip that extends from the retainer head top, the reinforcing strip being adapted for extending from the retainer head, the reinforcing strip having a nail slot that extends through the reinforcing strip;

at least one lug retainer that extends away from the base of the retainer head in substantially the same direction as the reinforcing strip, the lug retainer having a lug lower end, the lug retainer further having at least one resilient protrusion at a distance from the base of the retainer head, the resilient protrusion extending from the lug retainer towards the top of the retainer head and is adapted for elevating at least one lug on a roofing tile, so that attachment of the elevated retainer through the use of a nail through the retainer nail channel and into the roofing surface while the reinforcing strip and the resilient protrusion straddle the roofing tile and the lug of the roofing tile.

2. An elevated retainer according to claim 1 and further comprising a foot that is of integral, one-piece construction with the retainer lug, the foot being positioned between next to the resilient protrusion such that the resilient protrusion is located between the foot and the retainer head.

3. An elevated retainer according to claim 2 and further comprising a nail channel comprising an aperture that extends from the top to the bottom of the retainer head.

4. An elevated retainer according to claim 3 wherein said retainer head includes a V-shaped leading edge comprising a pair of angled surfaces that extend from top to the bottom of the retainer, and is adapted for diverting a flow of water around the elevated retainer.

* * * * *